US012714265B2

(12) United States Patent
Ciavarella et al.

(10) Patent No.: US 12,714,265 B2
(45) Date of Patent: Aug. 25, 2026

(54) METHODS AND SYSTEMS FOR AUTO-PRIMING AND MAINTAINING LIQUID PRIME IN A DISPENSER

(71) Applicant: GOJO Industries, Inc., Akron, OH (US)

(72) Inventors: Nick E. Ciavarella, Seven Hills, OH (US); Jackson W. Wegelin, Stow, OH (US); John P. Cichello, II, Wooster, OH (US); Stephen P. Casteel, Canal Fulton, OH (US)

(73) Assignee: GOJO Industries, Inc., Akron, OH (US)

( * ) Notice: Subject to any disclaimer, the term of this patent is extended or adjusted under 35 U.S.C. 154(b) by 155 days.

(21) Appl. No.: 18/609,061

(22) Filed: Mar. 19, 2024

(65) Prior Publication Data

US 2024/0315496 A1 Sep. 26, 2024

Related U.S. Application Data

(60) Provisional application No. 63/491,549, filed on Mar. 22, 2023.

(51) Int. Cl.
*A47K 5/12* (2006.01)

(52) U.S. Cl.
CPC ..... *A47K 5/1217* (2013.01); *A47K 5/12* (2013.01)

(58) Field of Classification Search
CPC ..... A47K 5/1217; A47K 5/06; A47K 5/12; A47K 5/1202; A47K 2005/1218
USPC ..... 222/333; 4/623, 626, 628
See application file for complete search history.

(56) References Cited

U.S. PATENT DOCUMENTS

| | | | | |
|---|---|---|---|---|
| 9,546,474 | B2 * | 1/2017 | Cochart | E03C 1/046 |
| 9,943,196 | B2 | 4/2018 | Mak et al. | |
| 10,065,199 | B2 | 9/2018 | Twaroski et al. | |
| 10,080,466 | B2 | 9/2018 | Ciavarella et al. | |
| 10,080,467 | B2 | 9/2018 | Ciavarella et al. | |
| 10,080,468 | B2 | 9/2018 | Ciavarella et al. | |
| 10,143,339 | B2 | 12/2018 | Ciavarella et al. | |
| 2013/0161358 | A1 * | 6/2013 | Tsai | B67D 7/62 222/325 |
| 2024/0315495 | A1 * | 9/2024 | Tramontina | A47K 5/1217 |

* cited by examiner

*Primary Examiner* — David J Walczak
(74) *Attorney, Agent, or Firm* — Calfee, Halter & Griswold LLP

(57) ABSTRACT

An exemplary soap or sanitizer dispenser includes a reservoir for holding soap or sanitizer, a pump, a dispensing spout and an object sensor. The pump is in fluid communication with the reservoir and with the dispensing spout. The dispensing spout is located remotely from the pump. The dispenser further includes a liquid present sensor. The liquid present sensor is proximate the dispensing spout. The dispenser further includes circuitry for causing the pump to pump liquid from the reservoir, circuitry for receiving a signal form the liquid level switch that liquid is present, circuitry for causing the pump to stop pumping liquid after liquid is detected at the liquid present sensor, circuitry for receiving a signal from the object sensor that an object has been detected and circuitry for causing the pump to dispense a dose of fluid.

20 Claims, 5 Drawing Sheets

METHODS AND SYSTEMS FOR AUTO-PRIMING AND MAINTAINING LIQUID PRIME IN A DISPENSER

CROSS-REFERENCE TO RELATED APPLICATIONS

This application claims priority to and any benefit of U.S. Provisional Application No. 63/491,549, filed Mar. 22, 2023, the content of which is incorporated herein by reference in its entirety.

BACKGROUND OF THE INVENTION

Dispensers for dispensing soap or sanitizer that have the soap or sanitizer reservoir located remotely from the dispensing spout often have issues with customer complaints that the dispenser is not working. Complaints often occur after the dispensers are refilled or have not been used in a period of time. The complaints may indicate a problem with the dispenser, however, often the complaint occurs because the dispensers do not dispense fluid within one to four actuations of the dispenser. This may occur if the person refilling the dispenser did not verify that the dispenser was properly primed, or if air gets into the liquid feed lines or liquid supply lines. Accordingly, there is a need to have dispensers that are not subject to customer complaints for not being properly primed or not maintaining their prime.

SUMMARY OF THE INVENTION

Exemplary soap or sanitizer dispenser and methods of operating such dispensers are disclosed herein. An exemplary soap or sanitizer dispenser include a reservoir for holding soap or sanitizer, a pump, a dispensing spout and an object sensor. The pump is in fluid communication with the reservoir and with the dispensing spout. The dispensing spout is located remotely from the pump. The dispenser further includes a liquid present sensor. The liquid present sensor is proximate the dispensing spout. The dispenser further includes circuitry for causing the pump to pump liquid from the reservoir, circuitry for receiving a signal form the liquid level switch that liquid is present, circuitry for causing the pump to stop pumping liquid after liquid is detected at the liquid present sensor, circuitry for receiving a signal from the object sensor that an object has been detected and circuitry for causing the pump to dispense a dose of fluid.

Another exemplary soap or sanitizer dispenser includes a reservoir for holding soap or sanitizer, a reservoir liquid level sensor, a pump, a dispensing spout located remotely from the pump and an object sensor. The pump is in fluid communication with the reservoir and with the dispensing spout. The dispensing spout is located remotely from the pump. The dispenser further includes a liquid present sensor, circuitry for determining the reservoir contains liquid, circuitry for causing the pump to pump liquid from the reservoir, circuitry for receiving a signal form the liquid present sensor that liquid is present, circuitry for causing the pump to stop pumping liquid when liquid is present at the liquid present sensor, circuitry for receiving a signal from the object sensor that an object has been detected, and circuitry for causing the pump to dispense a dose of fluid.

Another exemplary soap or sanitizer dispenser includes a reservoir for holding soap or sanitizer, a reservoir level sensor for sensing a selected level of liquid in the reservoir, a pump, a dispensing spout configured to be mounted proximate a countertop and remote from the reservoir. The dispenser further includes an object sensor. The pump is in fluid communication with the reservoir and with the dispensing spout. The dispensing spout is located at least one foot from the pump. The dispenser further includes a liquid level switch, wherein the liquid level switch detects the presence of liquid. The dispenser further includes circuitry for causing the pump to pump liquid from the reservoir, circuitry for receiving a signal form the liquid level switch that liquid is present, circuitry for causing the pump to stop pumping liquid when liquid is present at the liquid level switch or when liquid in the reservoir is below a selected level, circuitry for receiving a signal from the object sensor that an object has been detected, and circuitry for causing the pump to dispense a dose of fluid.

An exemplary methodology for controlling a dispenser for dispensing soap or sanitizer that includes a reservoir, a dispensing outlet, a liquid present sensor located proximate the dispensing outlet, an object sensor located proximate the dispensing outlet, a pump located remote from the dispenser outlet, a motor for operating the pump and control circuitry includes: determining no liquid is present at the liquid present sensor, energizing the motor to cause the pump to pump liquid from the reservoir toward the dispensing outlet, determining liquid is present at the liquid present sensor, deenergizing the motor to stop the pump from pumping liquid, detecting the presence of a hand by the object sensor and energizing the motor to cause the pump to dispense a dose of fluid.

BRIEF DESCRIPTION OF DRAWINGS

To further clarify various aspects of the present disclosure, a more particular description of inventive concepts will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale. Features and advantages of the present disclosure will be described and explained with additional specificity and detail through the use of the accompanying drawings in which.

DETAILED DESCRIPTION OF THE INVENTION

Figure 1:
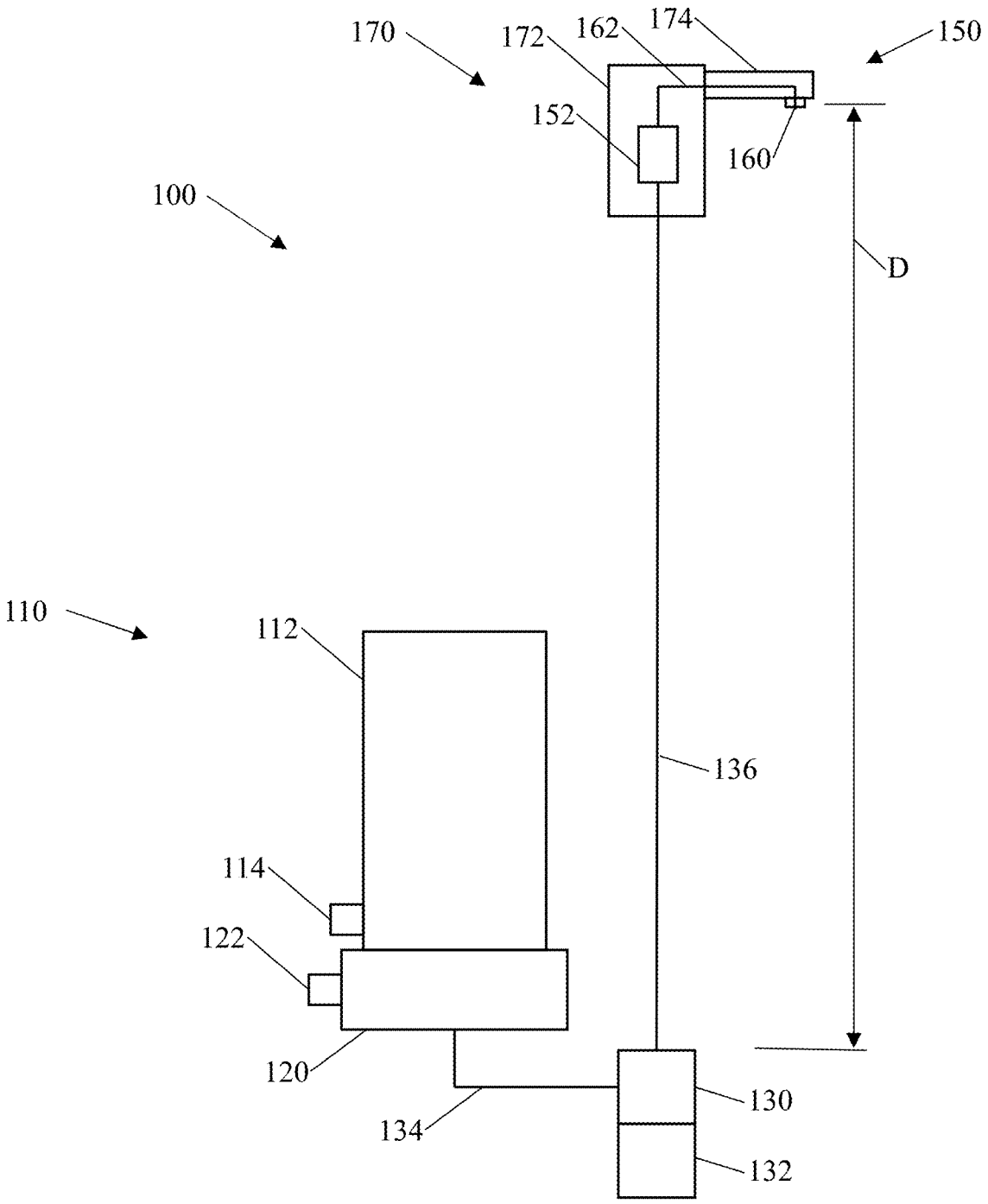
FIG. 1 is a simplified schematic diagram of a dispenser 100 having a reservoir located remote from the dispensing spout.

The following description refers to the accompanying drawings, which illustrate specific aspects of the present disclosure.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

Also, as used herein, voltages and values representing digitized voltages are considered to be equivalent for the purposes of this application, and thus the term "voltage" as used herein refers to either a signal, or a value in a processor representing a signal, or a value in a processor determined from a value representing a signal.

"Signal", as used herein includes, but is not limited to one or more electrical signals, analog or digital signals, one or more computer instructions, a bit or bit stream, or the like.

"Logic," synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions. The exemplary methodologies provide instructions for creating logic to control desired functions.

Values identified in the detailed description may be exemplary and may be different as needed for a particular dispenser and/or refill design. Accordingly, the inventive concepts disclosed and claimed herein are not limited to the particular values or ranges of values used to describe the embodiments disclosed herein.

FIG. 1 is a simplified schematic diagram of a soap or sanitizer dispenser 100. Soap or sanitizer dispenser 100 includes a liquid reservoir 110. Liquid reservoir 110 includes a permanent reservoir 120. Permanent reservoir 120 remains in place after the dispenser 100 is installed. A refill unit 112 is placed in fluid communication with permanent reservoir 120. Refill unit 112 may contain one or more quick connectors for connecting to permanent reservoir 120. Refill unit 112 may be removed and replaced, preferably after refill unit 112 is completely empty. An optional refill detection sensor 114 is included. Refill detection sensor 114 may be used by system circuitry (not shown) to determine if a refill unit 112 is present in the system. Liquid flows out of refill unit 112 into permanent reservoir 120 as liquid is drained out of permanent reservoir 120.

An optional reservoir level detector 122 is used to provide system circuitry (not shown) with a liquid level indicative of the amount of fluid remaining in the reservoir 110. Reservoir level detector 122 may detect a level of fluid in the reservoir. Level detector 122 may detect the level of liquid in the permanent reservoir 120 or the refill unit 112. Level detector 122 may be any type of level sensor, such as, for example, a float, a capacitance sensor, an optical sensor, such as, for example, an IR level sensor having one or more IR emitters and one or more IR receives, a visible light optical senser, an electrochemical sensor, an electromagnetic sensor, or the like. Reservoir level detector 122 may detect one or more levels or may detect real time levels. Preferably, reservoir level detector 122 detects one or more selected levels, such as, for example, permanent reservoir 120 full level, and/or permanent reservoir 120 at 80% full, and/or permanent reservoir 120 at 70% full, and/or permanent reservoir 120 at 50% full, reservoir 110 full level, and/or reservoir 110 at 50% full, and/or reservoir 110 at 20% full, and/or reservoir 120 at 10% full, and/or refill unit 112 at 50% full, and/or refill unit 112 full level at 30% full, and/or refill unit 112 full level at 20% full, and/or refill unit 112 full level at 10% full, at 5% full, at zero % full, or the like. The selected levels may be used to signal that a new refill unit 112 is required or the reservoir 110 needs to be refilled. In addition, level sensor 122 may be used by system circuitry (not shown) to prevent operation of the dispenser 100 below a selected liquid level to prevent the dispenser from drawing air into the liquid supply lines.

Soap or sanitizer dispenser 100 includes a pump 130 and motor 132. Pump 130 may be any type of pump. Preferably pump 130 is a sequentially activated diaphragm pump. Pump 130 may pump liquid only, or may pump liquid and air separately in the case of a foam dispenser. Exemplary foam at a distance sequentially activated pumps are shown and described in U.S. Non-Provisional application Ser. No. 18/159,697, which is titled Sequentially Activated Multi-Diaphragm Foam-At-A-Distance Dispenser Systems, filed on Jan. 26, 2023, and which is incorporated herein by reference in its entirety. For liquid only dispensers, similar pumps may be used, however, all the pump chambers may pump liquid rather than some pump chambers pumping air. A liquid inlet conduit 134 places pump 130 in fluid communication with reservoir 110.

Located remotely at a distance D from pump 130 is a dispensing outlet 160. The term remotely means a distance D of at least 1 foot. In some instances, the term remotely means at a distance D of least 2 feet. In some instances, the term remotely means a distance D of at least 3 feet.

A liquid present sensor 152 is located proximate dispensing outlet 160. Liquid present sensor 152 is preferably as close to dispensing outlet 160. The closer liquid present sensor 152 is to dispensing outlet 160, the less activations it will take to have the first dose of fluid dispensed from the dispensing outlet after the dispenser 100 has been primed. After the dispenser 100 has been primed, dispenser 100 only runs for a long enough period of time to dispense a selected volume of fluid. So if the distance/volume between liquid present sensor 152 and dispensing outlet 160 is equivalent to two dispenser 100 actuations, a dose of fluid will not be dispensed until the third activation. Accordingly, the closer liquid present sensor 152 is to dispensing outlet 160 the better. Liquid feed conduit 136 places liquid present sensor 152 in fluid communication with pump 130.

In some embodiments, system circuitry (not shown) is configured to operate the pump for a selected period of time after the liquid present sensor 152 detects the presence of liquid so that liquid flows for a corresponding distance past liquid present sensor 152. This allows the system to prime and set up dispenser 100 so that it takes no more than a selected number actuations of the dispenser to output the first dose of fluid. The selected number of actuations may be, for example 0 (i.e. the next actuation dispenses a dose of fluid), 1, 2, 3, 4, 5.

Liquid present sensor 152 may be any type of liquid present sensor, such as, for example, liquid level switch, an electromechanical sensor, an electrochemical sensor, a float, such as, for example, a magnetic float, an optical sensor, such as, for example, an IR sensor and emitter, a capacitance sensor, or the like. Exemplary liquid present sensors are described in more detail herein.

Liquid present sensor 152 is located in a vertical rising portion of the liquid flow path between the pump 130 and dispensing outlet 160.

FIG. 1 illustrates a fixture 170. Fixture 170 includes an optional main housing 172 and a spout 174. Main housing 172 and spout 174 may be a single piece and have a faucet type shape and be configured to be mounted in a countertop (not shown) proximate a sink (not shown) for dispensing soap as may be in the case of counter mount fixture. Optionally, spout 174 may be mounted on a wall (not shown) as in a through the wall dispenser system. In such a system, fluid present sensor 152 is preferably located as close to the dispensing outlet 160 as possible.

Dispenser 100 works particularly well in floor standing dispense systems, such as, for example, moveable floor mounted sanitizer dispenser systems. Spout 174 may be located at a convenient height for easy access, while all of the heavy components, such as, reservoir 110 may be located in the base of the floor standing dispensing systems. This lowers the center of gravity and makes the floor standing dispensing system very sturdy. It also allows for sleek dispenser designs.

Dispenser 100 includes other electronic components (not shown) that are required to perform the functions described herein, including, but not limited to, an object sensor, control circuitry, a power source, such as, for example, one or more batteries, etc.

Although the reservoir 110 has been shown and described as including a refill unit 112 and a permanent reservoir 120, reservoir 110 may be a single reservoir, and may be removable and replaceable or may be refillable.

Figure 2:
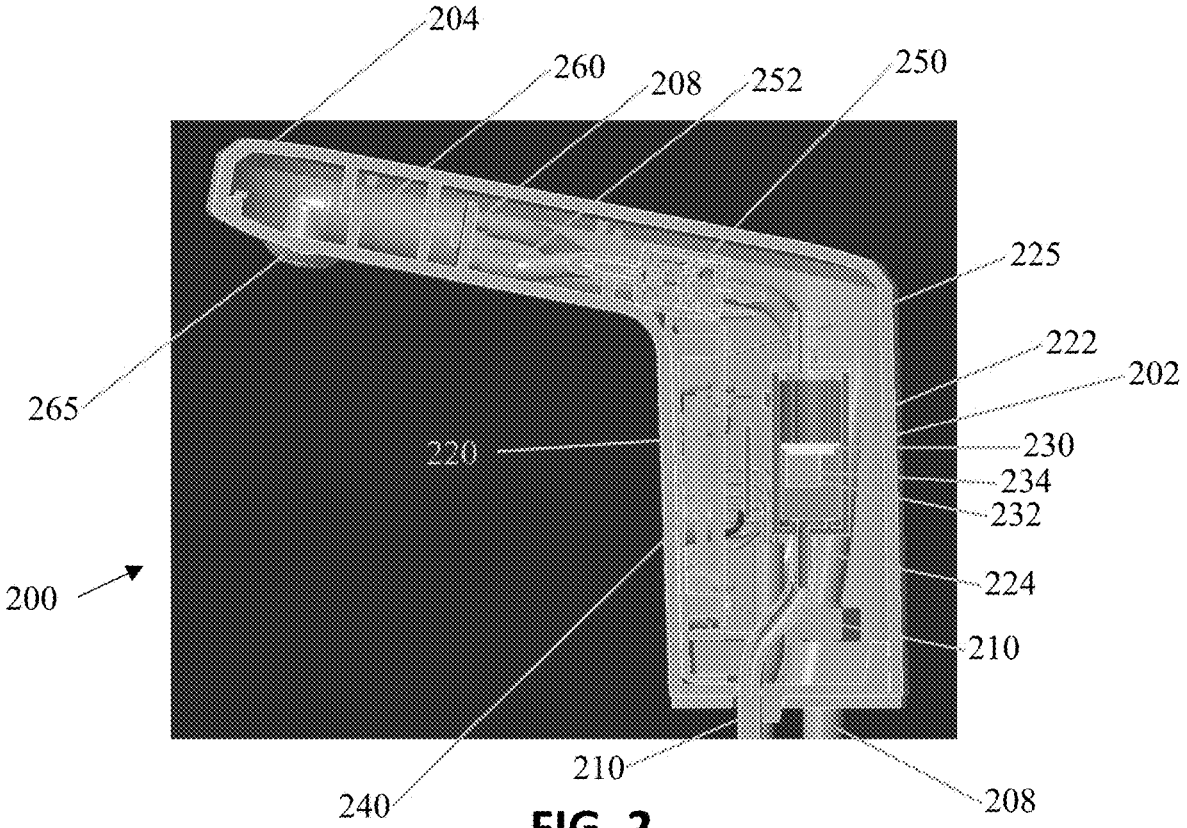
FIGS. 2 and 3 are cross-sectional views of an exemplary fixture having an exemplary liquid present sensor.
Figure 3:
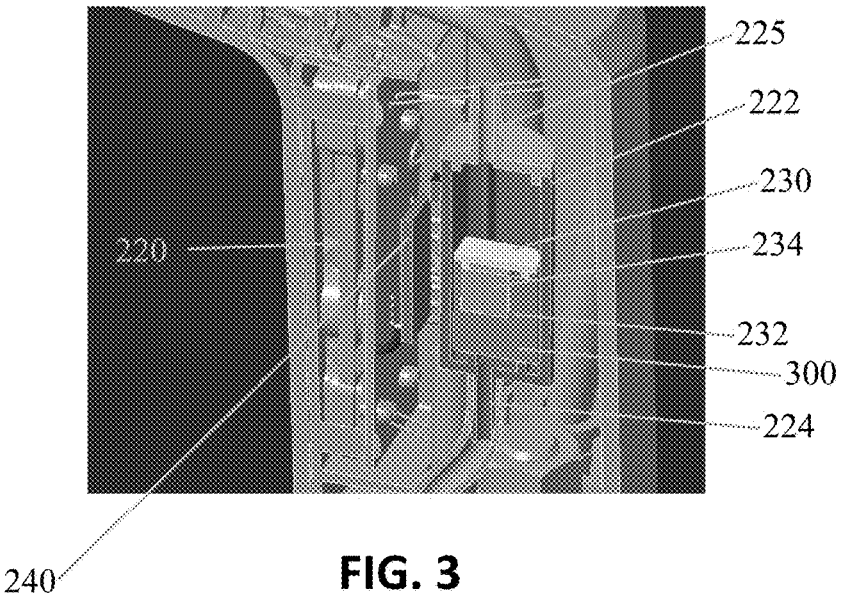

FIG. 2 is a cross-section of an exemplary fixture 200 for use in a dispenser. FIG. 3 is an enlarged partial cross-section of a portion of FIG. 2. Fixture 200 includes a main housing portion 202 and a spout 204. Although main housing portion 202 and spout 204 is shown as a counter-mount fixture, fixture 200 may have a configuration for a wall-mount fixture, a floor stand mounted fixture or the like. Fixture 200 is for a foam dispenser. Fixture 200 has an air conduit 208 that extends through fixture 200 to mixing chamber 260. During operation, air is pumped through air conduit 208 by an air pump (not shown). Fixture 200 has a liquid feed conduit 210. Liquid is pumped through liquid feed conduit 210 by a liquid pump (not shown). The air pump (not shown) and liquid pump (not shown) may be a sequentially activated diaphragm foam pump such as, exemplary sequentially activated diaphragm pumps shown and described in Applicants U.S. Pat. Nos. 9,943,196, 10,065,199, 10,080,466, 10,080,467, 10,143,339, and 10,080,468.

Each of which are incorporated herein in their entirety by reference. Liquid feed conduit 210 is in fluid communication with liquid present sensor 220. In this exemplary embodiment, liquid present sensor 220 is an electromechanical sensor. Liquid present sensor 220 includes a main housing 222 that has a liquid inlet 224 and a liquid outlet 225. A float 230, which includes a float housing 234 having a hollow portion and an upper buoyant portion, which provides enough buoyancy for the float 230 to float liquid as liquid flows into main housing 222. Located within float housing is a magnet 234. Float 230 is configured to allow fluid to freely flow past float 230 even when float 230 is located at the top of main housing 222. Such configurations may include, for example, one or more apertures, serrations, projections, indentations, etc.

Liquid present sensor 220 includes a sensor 240 located on a printed circuit board proximate main housing 222. Sensor 220 detects the position of float 230 and can determine a level of liquid in the main housing 220. Sensor 220 provides a level to dispenser control circuitry (not shown).

A liquid conduit (not shown) places liquid outlet 225 of liquid present sensor 220 in fluid communication with a one-way valve 250. Liquid outlet conduit 252 extends from one-way valve 250 to mixing chamber 260, where liquid and air mix together to form a foam which is dispensed out of dispensing outlet 265.

Figure 4:
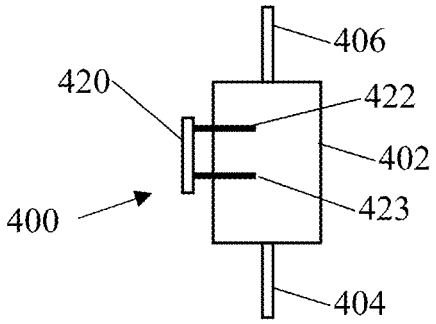
FIG. 4 is a simplified schematic view of another exemplary liquid present sensor.

FIG. 4 is another exemplary liquid present detector 400. Liquid present detector 400 is an electrochemical liquid present detector. Liquid present detector 400 includes a housing 402 having a liquid inlet 404 and a liquid outlet 406. Liquid present detector 500 includes a printed circuit board 420, a first electrode 422 and a second electrode 423. When liquid flows into housing 402 and flows over first electrode 422 and second electrode 423 a circuit is completed and, as a result, liquid present detector 400 determines that liquid is present and a signal is provided to the dispenser control circuitry (not shown).

Figure 5:
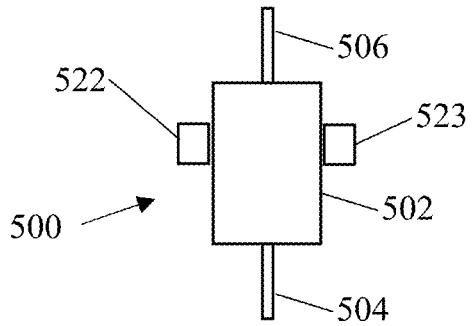
FIG. 5 is a simplified schematic view of another exemplary liquid present sensor.

FIG. 5 is another exemplary liquid present detector 500. Liquid present detector 500 is an optical liquid present detector. Liquid present detector 500 includes a housing 502 having a liquid inlet 504 and a liquid outlet 506. Liquid present detector 500 includes a printed circuit board (not shown), an IR emitter 522 and an IR receiver 523. When liquid flows into housing 502 and flows between IR emitter 522 and IR receiver 523 there is a change in light level, which indicates that liquid is present and a signal is provided to the dispenser control circuitry (not shown). In some embodiments, IR emitter 522 and IR receiver 523 are only activated when a fluid reservoir is filled or replaced and is deactivated after the dispenser is primed.

Figure 6:
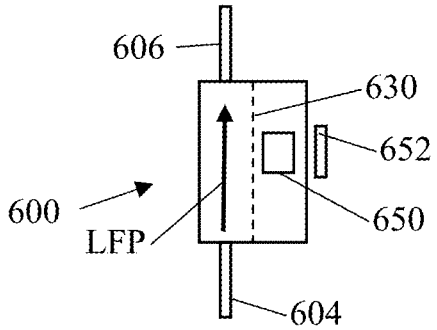
FIG. 6 is a simplified schematic view of another exemplary liquid present sensor.

FIG. 6 is another exemplary liquid present detector 600. Liquid present detector 600 is an electromechanical liquid present detector. Liquid present detector 600 includes a housing 602 having a liquid inlet 604 and a liquid outlet 606. A separator 630 is included in housing 602. Separator 630 is porous and allows liquid to freely travel therethrough. Separator 630 ensures that float 650 is outside of the primary liquid flow path LFP. Thus, float 650 does not provide any resistance to the liquid flowing though liquid present detector 600. Liquid present detector includes a sensor 652 that senses the position of float 650 to determine if liquid is present and a signal is provided to the dispenser control circuitry (not shown).

Figure 7:
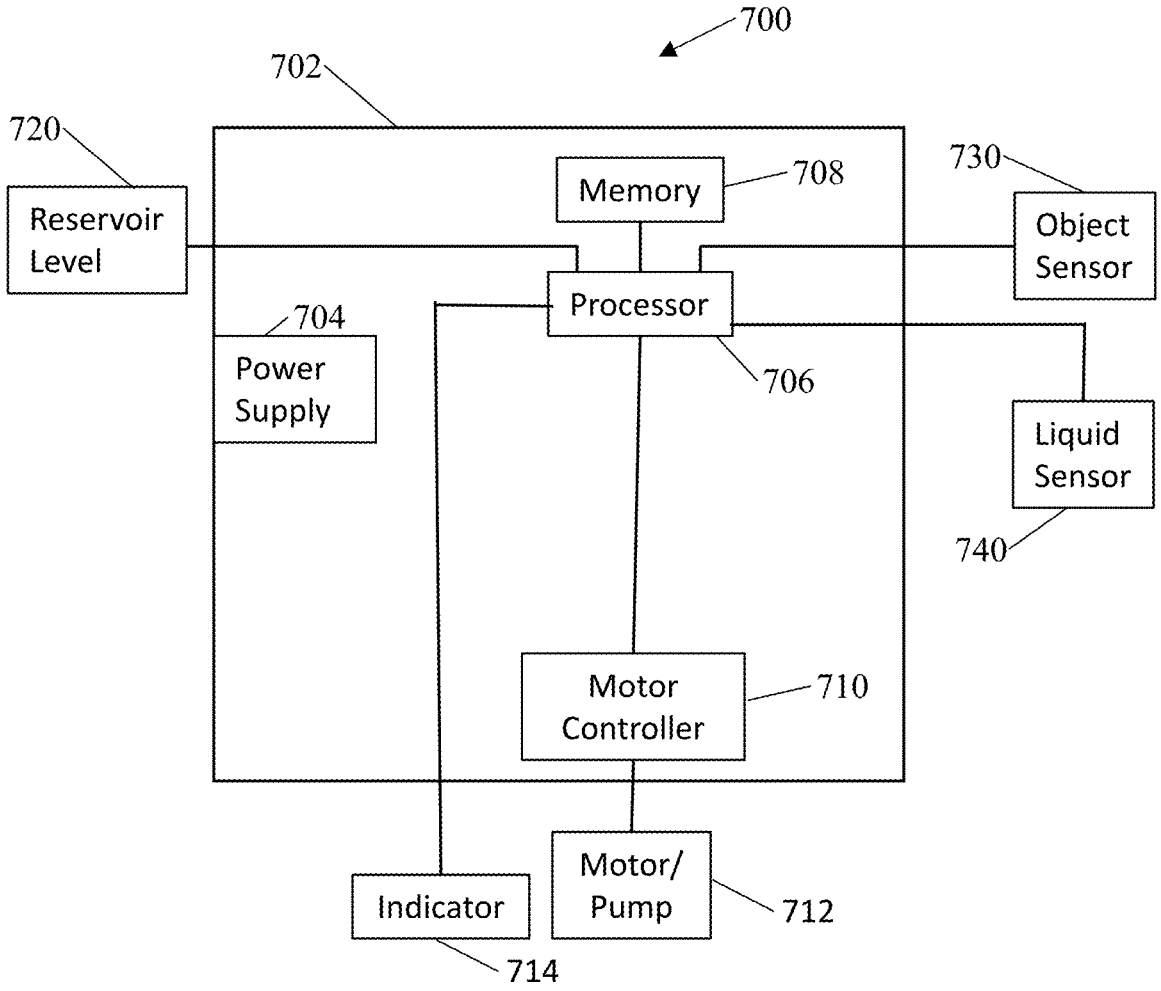
FIG. 7 is a simplified schematic diagram of control circuitry for an exemplary dispenser having a reservoir that is located remotely from the dispensing spout.

FIG. 7 is a simplified schematic of control circuitry for an exemplary dispenser 700. It should be understood that additional electrical components may be included in the dispenser 700 that are not shown herein, but would be understood by one of ordinary skill in the art to be included herein, such as, for example, power conditioning circuitry. The exemplary dispenser 700 includes processor 706, which is in circuit communication with memory 708. Processor 706 may be any type of processor, such as, for example, a microprocessor or microcontroller, discrete logic, such as an application specific integrated circuit (ASIC), other programmed logic device or the like. Depending on the need, memory 708 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, magnetic disk or tape, optically readable mediums including CD-ROM and DVD-ROM, or the like, or combinations of different types of memory. In some embodiments, the memory 708 is separate from the processor 706, and in some embodiments, the memory 708 resides on or within processor 706.

Power supply 704 may be used to power any of the electrical components in the dispenser system, including for example, motor controller 710, reservoir level sensor 720, object sensor 730, liquid present sensor 740, processor 706, indicator 714, and any other electrical components required for dispensing products as described herein. In some embodiments, power supply 704 is one or more batteries. In some embodiments, power supply 704 is a connector for connecting to an AC power supply, such as, for example, 120 VAC. Motor controller 710 provides power to motor/pump 712.

Object sensor 730 senses when an object, such as, for example, a hand is placed beneath the dispensing spout. An exemplary object sensor 730 is an IR sensor and includes an IR emitter and an IR receiver. Object sensor 730 is in circuit communications with processor 706. When an object is detected in the detection zone of sensor, the processor causes the motor controller 710 to power pump/motor 712 to dispense dose of fluid.

Dispenser 700 includes optional reservoir level sensor 720. Reservoir level sensor 720 may be sense a continuous level of liquid in the reservoir, or may just determine the level of liquid at selected levels as described above. Dispenser 700 also includes liquid present sensor 740, which has been described above.

Figure 8:
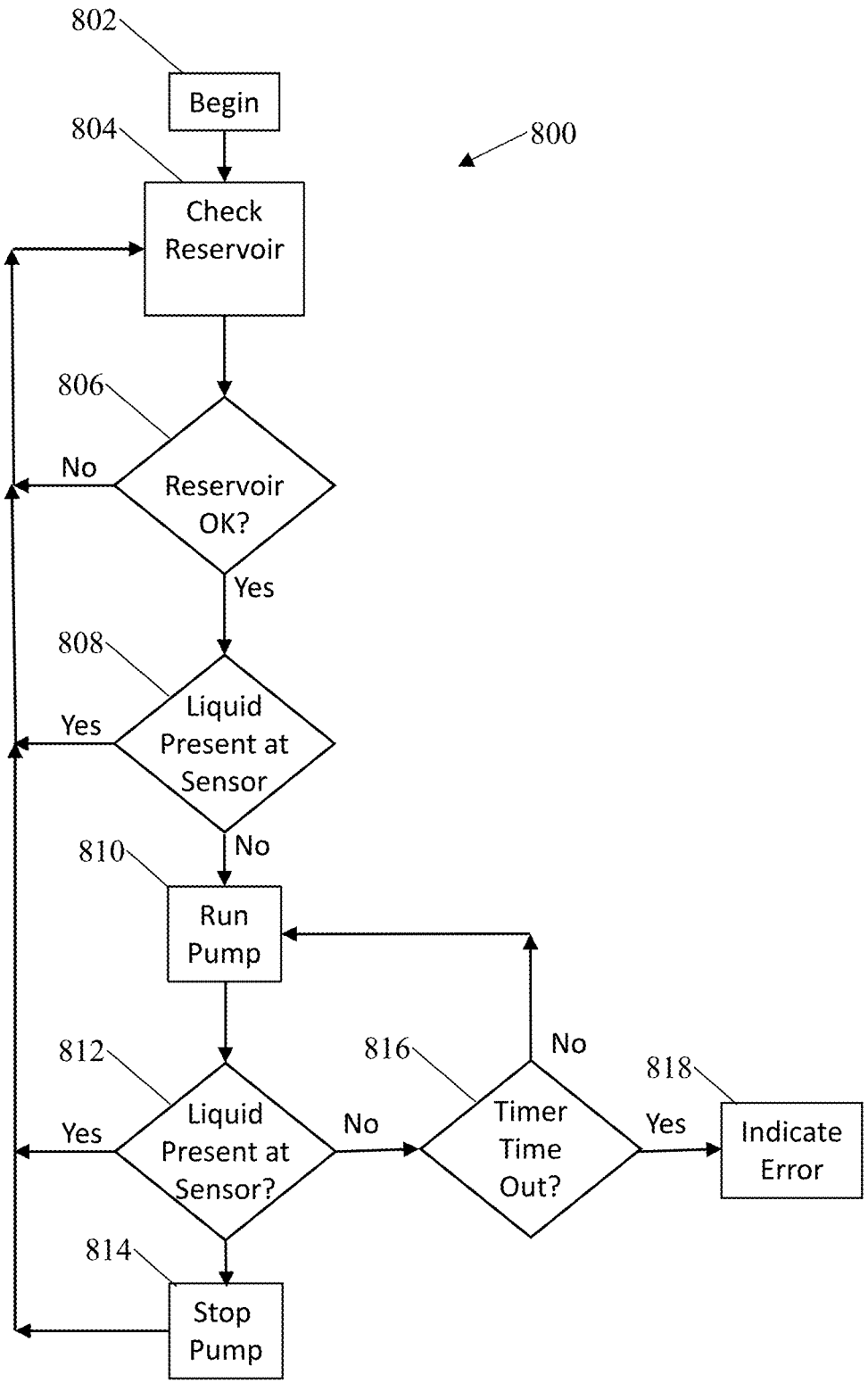
FIG. 8 is an exemplary methodology of a dispenser that self-prime/maintains a prime.

FIG. 8 is an exemplary methodology 800 for priming and/or maintaining prime in a dispenser. Methodologies according to the present disclosure may include additional steps or blocks. Methodologies according the present disclosure may have fewer steps or blocks. Unless otherwise stated, the steps or blocks may be performed in other orders. The exemplary methodology begins at block 802. At block 804 a check is made on the reservoir. The check may include, for example, a reservoir level, whether a refill unit is present, whether the reservoir was just refilled. A determination is made at block 806 as to whether the reservoir status indicates the reservoir is ok. The reservoir may be ok if the reservoir level is at or above a selected level, if the reservoir is above a selected level and a refill unit is present, if the reservoir was recently filled, or the like. If the reservoir is not "ok" the exemplary methodology loops to block 804. If the reservoir is "ok", a determination is made at block 808 as to whether liquid is present at the liquid present sensor. If liquid is present at the liquid present sensor, the methodology loops to block 804. If no liquid is present, the methodology flows to block 810 where the control circuitry causes the pump to be operated. At block 812, a determination is made as to whether liquid is present at the liquid present sensor. If no liquid is present, the methodology flows to block 816 where a determination is made as to whether a timer has timed out. The timer may be used to prevent the pump from continually operating and draining a batter if there is a problem with the system and the system will not prime. If the timer has not timed out, the methodology flows to block 810 and the pump continues to run. If the timer times out, the methodology flows to block 818, the pump is stopped, and an error is indicated. The error may be indicated by, for example, flashing a light, sending a communication signal to a maintenance worker or central computer.

If at block 812 liquid is detected at the liquid present sensor, the pump is stopped at block 814. The control circuitry may stop the pump immediately upon detection of sufficient liquid at liquid present sensor. The control circuitry may initiate a delayed pump stop. For example, the control circuitry may cause the pump to run for a selected period of time after liquid is detected by the liquid present detector to cause liquid to flow a selected distance past liquid present sensor. In some instances, the control circuitry may cause the pump to run for a selected number of revolutions after detection of liquid by the liquid present sensor. Once the pump is stopped, the methodology flows to block 804.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. It is not the intention of the applicant to restrict or in any way limit the scope of the appended claims to such detail. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order in which the steps are presented to be construed as required or necessary unless expressly so stated.

The invention claimed is:

1. A soap or sanitizer dispenser comprising:
a reservoir for holding soap or sanitizer;
a pump;
a dispensing spout;
an object sensor;
wherein the pump is in fluid communication with the reservoir and with the dispensing spout;
wherein the dispensing spout is located remotely at a distance of at least 1 foot from the pump;
a liquid present sensor;
wherein the liquid present sensor is located in a liquid flow path and is proximate the dispensing spout;
circuitry for causing the pump to pump liquid from the reservoir;
circuitry for receiving a signal from the liquid present sensor that liquid is present;
circuitry for causing the pump to stop pumping liquid after liquid is detected at the liquid present sensor;
circuitry for receiving a signal from the object sensor that an object has been detected; and
circuitry for causing the pump to dispense a dose of fluid.

2. The soap or sanitizer dispenser of claim 1 further comprising a mixing chamber located in the liquid fluid path downstream of the liquid present sensor and wherein the pump pumps air to the mixing chamber to mix with the liquid to form a foam.

3. The soap or sanitizer dispenser of claim 1, wherein the control circuitry for causing the pump to stop pumping liquid stops the pump from pumping liquid after a selected period of time after liquid is detected at the liquid present sensor.

4. The soap or sanitizer dispenser of claim 1, wherein the control circuitry for causing the pump to stop pumping liquid stops the pump from pumping liquid after a selected number of revolutions of the pump after liquid is detected at the liquid present sensor.

5. The soap or sanitizer dispenser of claim 1, wherein the liquid present sensor comprises a main housing; a liquid inlet; and a liquid outlet; wherein the liquid present sensor is located in line with the pump and the dispensing outlet.

6. The soap or sanitizer dispenser of claim 1, wherein the liquid present sensor comprises an electromechanical sensor.

7. The soap or sanitizer dispenser of claim 1, wherein the liquid present sensor is an electrochemical sensor comprising two or more electrodes located in a liquid flow path between the pump and the dispensing nozzle.

8. The soap or sanitizer dispenser of claim 1, wherein the liquid present sensor is an optical sensor.

9. The soap or sanitizer dispenser of claim 1, wherein the liquid present sensor is a capacitance sensor.

10. The soap or sanitizer dispenser of claim 1 further comprising a reservoir liquid level sensor.

11. The soap or sanitizer dispenser of claim 10 further comprising circuitry for preventing the pump from pumping if the liquid in the reservoir is below a selected level.

12. The soap or sanitizer dispenser of claim 1 further comprising a spout housing, wherein the liquid present sensor is located within the spout housing.

13. The soap or sanitizer dispenser of claim 1, wherein the dispensing spout is located above a countertop and the reservoir is located below the countertop.

14. The soap or sanitizer dispenser of claim 1, wherein the dispensing spout is located on a first side of a wall and the reservoir is located on a second side of the wall.

15. The soap or sanitizer dispenser of claim 1, wherein located at least 2 foot from the pump.

16. A soap or sanitizer dispenser comprising:
a reservoir for holding soap or sanitizer;
a reservoir liquid level sensor;
a pump;
a dispensing spout located remotely from the pump;
an object sensor;
wherein the pump is in fluid communication with the reservoir and with the dispensing spout;
wherein the dispensing spout is located remotely at a distance of at least 1 foot from the pump;
a liquid present sensor located in fluid communication with a liquid flow path and located proximate the spout;
circuitry for determining the reservoir contains liquid;
circuitry for causing the pump to pump liquid from the reservoir;
circuitry for receiving a signal form the liquid present sensor that liquid is present;
circuitry for causing the pump to stop pumping liquid when liquid is present at the liquid present sensor;
circuitry for receiving a signal from the object sensor that an object has been detected; and
circuitry for causing the pump to dispense a dose of fluid.

17. The soap or sanitizer dispenser of claim 16, wherein the circuitry for causing the pump to stop pumping delays stopping the pump form pumping for a selected period of time after liquid is detected at the liquid present sensor.

18. A soap or sanitizer dispenser comprising:
a reservoir for holding soap or sanitizer;
a reservoir level sensor for sensing a selected level of liquid in the reservoir;
a pump;
a dispensing spout configured to be mounted proximate a countertop and remote from the reservoir;
an object sensor;
wherein the pump is in fluid communication with the reservoir and with the dispensing spout;
wherein the dispensing spout is located remotely at least one foot from the pump;
a liquid level switch;
wherein the liquid level switch detects the presence of liquid in a liquid flow path from the pump to the spout;
circuitry for causing the pump to pump liquid from the reservoir;
circuitry for receiving a signal from the liquid level switch that liquid is present;
circuitry for causing the pump to stop pumping liquid when liquid is present at the liquid level switch or when liquid in the reservoir is below a selected level;
circuitry for receiving a signal from the object sensor that an object has been detected; and
circuitry for causing the pump to dispense a dose of fluid.

19. The soap or sanitizer dispenser of claim 18, wherein the selected level of liquid in the reservoir is zero.

20. The soap or sanitizer dispenser of claim 18, wherein the selected level of liquid in the reservoir is less than 5% of the maximum volume of liquid in the reservoir.

* * * * *